US009212798B2

(12) United States Patent
Seipel

(10) Patent No.: US 9,212,798 B2
(45) Date of Patent: Dec. 15, 2015

(54) LIGHTING DEVICE FOR VEHICLES

(71) Applicant: Hella KGaA Hueck & Co., Lippstadt (DE)

(72) Inventor: Martin Seipel, Bad Wünnenberg (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 73 days.

(21) Appl. No.: 14/264,479

(22) Filed: Apr. 29, 2014

(65) Prior Publication Data

US 2014/0321133 A1 Oct. 30, 2014

(30) Foreign Application Priority Data

Apr. 30, 2013 (DE) ..... 10 2013 104 373

(51) Int. Cl.
*F21S 8/10* (2006.01)
*F21V 21/00* (2006.01)

(52) U.S. Cl.
CPC ..... *F21S 48/115* (2013.01); *F21S 48/1154* (2013.01); *F21S 48/13* (2013.01); *F21S 48/1747* (2013.01)

(58) Field of Classification Search
CPC . F21S 48/115; F21S 48/1154; F21S 48/1159; F21S 48/13; F21S 48/1388; F21S 48/1747
USPC ..... 362/507, 538–539, 543–545
See application file for complete search history.

(56) References Cited

FOREIGN PATENT DOCUMENTS

| | | | |
|---|---|---|---|
| DE | 102005041234 | A1 | 3/2007 |
| DE | 102011077132 | A1 | 1/2012 |
| DE | 102011012742 | A1 | 6/2012 |

*Primary Examiner* — Jason Moon Han
(74) *Attorney, Agent, or Firm* — Husch Blackwell LLP

(57) ABSTRACT

A lighting device for vehicles with a minimum of two light modules, each comprising a number of LED light sources for the generation of a first light function and a second light function. One light module is a basic light module and the other light module is a long-range light module. A first light source and a second light source are arranged in the basic light module, so that when the first LED light source is energized, a first partial light beam for the creation of a first light function is radiated. When both the second LED light source and the first LED light source are energized, a second partial light beam for the creation of a second light function is radiated. A first LED light source and a second LED light source may also be arranged in the long-range light module, so that when the first LED light source is energized, a first partial light beam for the creation of the first light function is radiated. When both the second LED light source and the first LED light source are energized, a second partial light beam for the creation of the second light function is radiated. The first light function is created by the superimposition of the first partial light beam of the basic light module and the first partial light beam of the long-range light module, and the second light function by superimposition of the second partial light beams of the basic light module and the long-range light module.

8 Claims, 2 Drawing Sheets

LIGHTING DEVICE FOR VEHICLES

CROSS REFERENCE

This application claims priority to German Patent Application No. 10 2013 104373.9 filed Apr. 30, 2013, and hereby incorporates this document by reference.

TECHNICAL DESCRIPTION OF THE INVENTION

The invention relates to a lighting device for vehicles with a minimum of two light modules, each comprising a number of LED light sources for the generation of a first light function and a second light function.

From DE 10 2006 021 694 B4, a lighting device for vehicles is known, which comprises several light modules, each having a number of LED light sources to be able to provide different light functions. A control unit is provided, so that the light modules are switched on if for example a low beam and/or high beam light distribution is required. In addition, actuators are assigned to the light modules, so that bend lighting or headlamp leveling functions can be realized. The respective light modules are designed to provide a specific light function. This means that the appearance of light modules arranged next to one another differs due to the different luminous intensities. It is therefore not possible to achieve a homogeneous appearance in the operating state of the lighting device, which would be particularly desirable with a four-eyes vehicle headlight front.

SUMMARY OF THE INVENTION

It is therefore the task of the present invention to further develop a lighting device for vehicles with a multitude of light modules, so that light modules arranged next to one another feature a homogeneous appearance, particularly when in operation.

To solve this task, the invention in combination with the preamble of Claim 1 is characterized in that one light module is embodied as a basic light module and the other light module is embodied as a long-range light module, wherein in the basic light module a first LED light source and a second LED light source are arranged so that in the energized state of the first LED light source a first partial light beam for the creation of a first light function is radiated on one hand, and that in the energized state of the second LED light source a second partial light beam for the creation of a second light function is radiated on the other hand, wherein in the long-range light module a first LED light source and a second LED light source are arranged so that in the energized state of the first LED light source, a first partial light beam is radiated for the creation of the first light function on one hand, and that in the energized state of the second LED light source, a second partial light beam is radiated for the creation of a second light function on the other hand, so that the first light function is created by a superimposition of the first partial light beam of the basic light module and the first partial light beam of the long-range light module, and the second light function is created by a superimposition of the second partial light beam of the basic light module and the long-range light module.

The invention allows a homogenous appearance of at least two light modules in their operating state, as light of a common illuminance scope is radiated from the light modules.

An observer perceives the two light modules as twin-light modules of identical brightness. According to the invention, the given light function is created by the superimposition of a partial light beam created by a basic light module and a further partial light beam created by a long-range light module.

According to a further development of the invention, the basic light module and the long-range light module each comprise a reflector and two LED light sources assigned to each of the reflectors, so that the two light modules are similar with regard to their dimensions and their design. Essentially it is the different design of the two reflectors, which causes the basic light module to radiate a partial light beam with a relatively large beam spread and the long-range light module to radiate a partial light beam with a relatively small beam spread.

According to a further development of the invention, the basic light module and the long-range light module have in common, that they radiate partial light beams with different cut-off lines. By this means, a low beam light distribution and a high beam light distribution can be easily created. For the creation of the low beam, the LED light sources of the two light modules are energized, which lead to a partial light distribution with a low cut-off line. For the creation of the high beam light distribution, further LED light sources of the same light modules are energized, whose partial light beams lead to a light distribution with a higher cut-off line.

According to a further development of the invention, an actuator for the creation of a bend lighting function and/or a headlamp leveling control is assigned to the basic light module and the long-range light module. The two light modules are connected to one another by means of a coupling unit, so that a single actuator is sufficient for the adjustment. By this means, fewer components are required.

According to a further development of the invention, the basic light module and the long-range light module are arranged in a common housing and/or in neighboring housing pockets of the same housing. A compact headlamp with a two-eyes headlight front can be advantageously created by this means.

According to a further development of the invention, the reflectors of the basic light module and of the long-range light module are embodied as free form reflectors; this allows a purposeful direction of the light with a homogeneous embodiment of the same.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
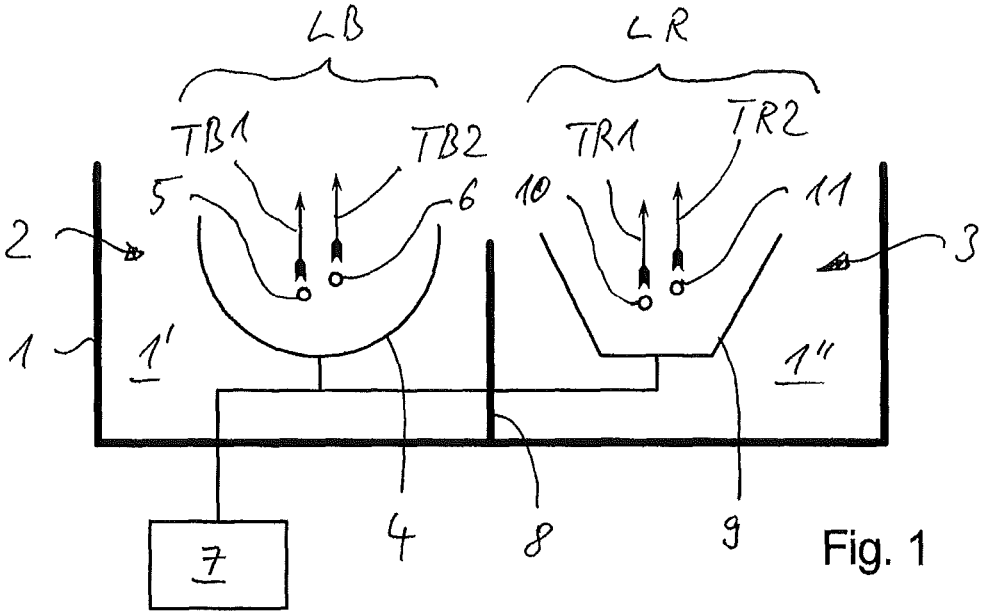
FIG. 1: A schematic top view of a lighting device.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

A lighting device for vehicles is preferably employed as headlamp in a front region of a motor vehicle. Here, the lighting device serves the creation of a four-eyes vehicle front of the vehicle featuring four light modules with an identical impression of brightness.

One housing 1 each with a basic light module 2 as a first light module and a long-range light module 3 as a second light module can be arranged in a front corner area of the vehicle in a body opening which is not represented. The basic light module 2 is arranged in a first housing pocket 1' and the long-range light module 3 is arranged in a second housing pocket 1", being adjacent to the first housing pocket 1'.

The basic light module 2 has essentially a reflector 4 and a first LED-light source 5 as well as a second LED-light source 6. The reflector 4 can be embodied as a free-form reflector which interacts with the first LED light source 5 and the second LED light source 6 so that a basic light distribution LB is always radiated.

Figure 2:
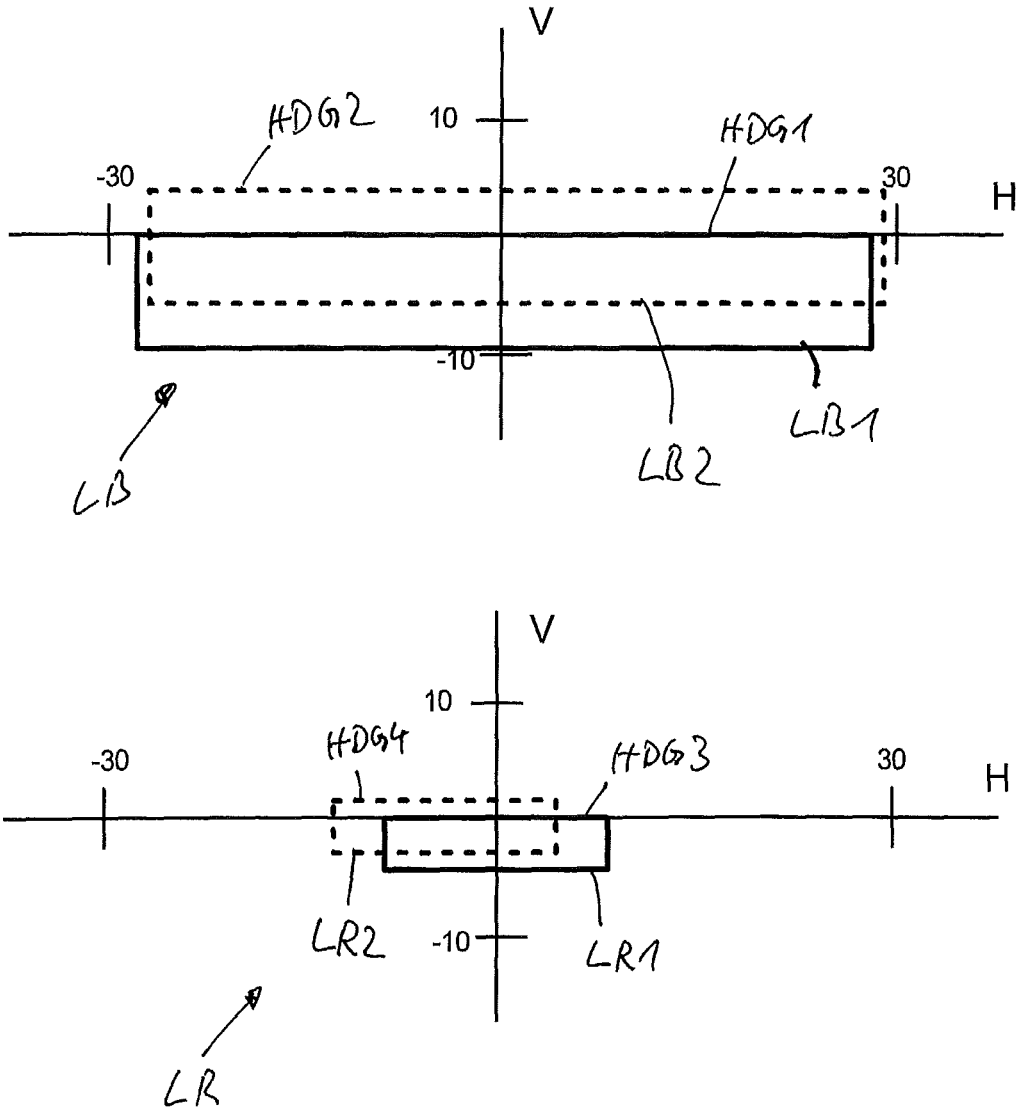
FIG. 2: A schematic representation of several light distributions of the lighting device.

The first LED light source 5 together with the reflector 4 creates a first partial light beam TB1. This results in a light distribution LB1 having a relatively wide beam spread in the horizontal direction, see FIG. 2. The second LED light source 6 together with the reflector 4 creates a second partial light beam TB2 which creates a partial light distribution LB2 having essentially the same beam spread as the partial light distribution LB1. In contrast to the partial light distribution LB1, however, the partial light distribution LB2 has a cut-off line HDG2 running above a cut-off line HDG1 of the first partial light distribution LB1. The cut-off line HDG1 of the first partial light distribution LB1 runs essentially along a horizontal plane H of a measuring screen and serves as a partial light beam for the creation of a low beam light distribution AL.

A control unit 7 is provided for the switching-on or off of the first LED light source 5 and the second LED light source 6. If a high beam light distribution FL is to be created, the second LED light source 6 is switched on in addition to the first light source 5, so that the basic light distribution LB is realized with a raised cut-off line HDG2.

The distinctive feature of the partial light distributions LB1 and LB2 resp. LB is that a relatively large luminous flux with a beam spread of +/−20° C. in the horizontal direction and +/−5° C. in the vertical direction is created.

There is a further reflector 9 for the creation of the long-range light module 3 with a first LED light source 10 and a second LED light source 11 being assigned to the same, arranged in the second housing pocket 1", which is separated from the first housing pocket 1' by an intermediate wall 8. The reflector 9 is/can be embodied as a free form reflector, whose reflector surfaces are, however, designed so that they create a partial light distribution LR1, LR2, LR when interacting with the first LED light source 10 and/or the second LED light source 11, whose beam spread in the horizontal direction is smaller than the partial light distribution TB1, TB2, LB of the basic light module 2, but whose luminous intensity is preferably higher.

The LED light sources 10, 11 of the long-range light module 3 are controlled by the same control unit 7 as the LED light sources 5, 6 of the basic light module 2.

When the first LED light source 10 is switched on, a partial light beam TR1 for the creation of a first partial light distribution LR1 is radiated. When the second LED light source 11 is switched on, a second partial light beam TR2 for the creation of a second partial light beam LR2 is radiated. In comparison to the first partial light distribution LR1, the second partial light distribution LR2 has a cut-off line HDG4, which, on a measuring screen, appears higher in the vertical direction than a cut-off line HDG3 of the first partial light distribution LR1. The horizontal beam spread of the two light distributions LR1 and LR2 may for example be +/−10° C. In the vertical direction, the two light distributions LR1 and LR2 can each be in a range of +/−3° C.

If a low beam light distribution AL is to be created, the first light source 5 of the basic light module 2 and the first light source 10 of the long-range light module 3 are switched on by means of the control unit 7. The low beam light distribution AL results from the superimposition of the partial light distributions LB1 and LR1 radiated by the partial light beams TB1 and TR1. Hence, the following formula applies:

$$AL=TB1+TR1=LB1+LR1.$$

If a high beam light distribution FL is to be created, the second LED light source 6 of the basic light module 2 and the second LED light source 11 of the long-range light module 3 are switched on in addition by means of the control unit 7, so that all four LED light sources 5, 6, 10, 11 are switched on. Therefore, the partial light beams TB2 and TR2 are switched on in addition, which feature are higher cut-off line in the vertical direction. Hence, the following formula applies for the high beam light distribution:

$$FL=(TB1+TB2)+(TR1+TR2)=(LB1+LB2)+(LR1+LR1)=LB+LR.$$

For the embodiment of a bend lighting or a headlamp leveling function, an actuator can be assigned to the basic light module 2 and/or the long-range light module 3. If the two light modules 2, 3 comprise a coupling unit, the bend lighting function and/or the headlamp leveling function can be effected by a single actuator, which can be controlled by the control unit 7.

The invention can be used for other, different light functions by superimposition of partial light beams. By distributing the light function to several light modules, the specified total light beam can be formed by the superimposition of several partial light beams.

The LED light sources are each embodied as light-emitting diodes, which may for example be arranged on a printed circuit board. Alternatively, the light sources can also be made from a different semiconductor material.

LIST OF REFERENCE SIGNS

1, 1', 1" Housing/housing pocket
2 Basic light module
3 Long-range light module
4 Reflector
5 1st LED light source
6 2nd LED light source
7 Control unit
8 Intermediate wall
9 Reflector
10 1st LED light source
11 2nd LED light source

The invention claimed is:

1. A lighting device for vehicles with a minimum of two light modules, comprising:

at least two said light modules, each including a number of LED light sources for the generation of a first light function and a second light function, wherein one light module is a basic light module for creating a large beam spread and the other light module is a long-range light module for creating a small beam spread, wherein a first light source and a second light source are arranged in the basic light module, so that in the energized state of a first LED light source, a first partial light beam for the creation of a first light function is radiated, and in the energized state of a second LED light source and the first LED light source, a second partial light beam for the creation of a second light function is radiated, wherein a third LED light source and a fourth LED light source are arranged in the long-range light module, so that in the energized state of the third LED light source a first partial light beam for the creation of the first light function is radiated, and in the energized state of the fourth LED light source and the third LED light source a second partial light beam for the creation of the second light function is radiated, wherein the first light function is created by the superimposition of the first partial light beam of the basic light module and the first partial light beam of the long-range light module, and the second light function is created by superimposition of the second partial light beams of the basic light module and the long-range light module.

2. The lighting device according to claim 1, wherein the basic light module and the long-range light module each have a reflector, wherein the reflector of the basic light module is shaped so that the partial light beams reflected by it create a light distribution with a large beam spread, and wherein the reflector of the long-range light module is shaped so that partial light beams reflected by it create a light distribution with a small beam spread.

3. The lighting device according to claim 2, wherein the first LED light source and the second LED light source of the basic light module are positioned relative to the reflector of the same so that the first partial light beam and the second partial light beam are radiated with a large beam spread, but with different cut-off lines.

4. The lighting device according to claim 2, wherein the third LED light source and the fourth LED light source of the long-range light module are positioned relative to the reflector of the same so that the first partial light beam and the second partial light beam are radiated with a small beam spread, but with different cut-off lines.

5. The lighting device according to claim 1, characterized in that further including a control unit for controlling is provided by means of which the LED light sources of the basic light module and of the long-range light module so that a low beam function is created as a first light function and a high beam function as a second light function.

6. The lighting device according to claim 1, further including a coupling unit coupling the basic light module with the long-range light module so that by the intervention of only one single actuator on the basic light module or on the long-range light module, a bend lighting function and/or a headlamp leveling function can be set.

7. The lighting device according to claim 1, wherein the basic light module and the long-range light module have an identical size and are arranged in a common housing and/or neighboring housing pockets of the same housing.

8. The lighting device according to claim 2, wherein the reflector of the basic light module and/or the long-range light module is embodied as a free form reflector.

* * * * *